United States Patent [19]

Wien et al.

[11] 4,006,439

[45] Feb. 1, 1977

[54] CIRCUIT INTERRUPTER HAVING AN INSULATED BRIDGING CONTACT

[75] Inventors: Raymond E. Wien, Penn Township; Eugene H. Seidling, Monroeville; Nicholas A. Tomasic, Plum Boro, all of Pa.

[73] Assignee: Westinghouse Electric Corporation, Pittsburgh, Pa.

[22] Filed: Sept. 11, 1975

[21] Appl. No.: 612,608

[52] U.S. Cl. ..... 335/15; 335/194

[51] Int. Cl.[2] ..... H01H 83/00

[58] Field of Search ..... 335/6, 8, 15, 165, 185, 335/188, 191, 192, 194, 197

[56] References Cited

UNITED STATES PATENTS

| | | | |
|---|---|---|---|
| 2,127,813 | 8/1938 | Graves | 335/194 |
| 2,409,115 | 10/1946 | Ellis et al. | 335/132 X |
| 2,424,308 | 7/1947 | Ellis et al. | 335/132 X |
| 2,550,110 | 4/1951 | Ellis | 335/132 X |
| 2,679,561 | 5/1954 | Thompson | 335/194 |
| 3,864,652 | 2/1975 | Zubaty et al. | 335/194 |
| 3,883,781 | 5/1975 | Cotton | 335/6 X |

*Primary Examiner*—George Harris
*Attorney, Agent, or Firm*—R. E. Converse

[57] ABSTRACT

A circuit interrupter particularly suitable for use in an oil filled distribution transformer having an elongated contact arm pivotable about one end with a movable contact attached to the other end through suitable insulating members to electrically isolate the movable contact from the elongated contact arm. The movable contact is a bridging contact for completing a series circuit through two stationary contacts. The movable bridging contact is spring biased away from the elongated contact arm. A retainer restricts the movement of the bridging contact away from the insulating members attached to the elongated contact arm. The biasing spring is disposed between the insulating members and the retainer. Grooves formed in the sides of the insulating members restrict rotational movement of the retainer and bridging contact. For larger circuit interrupters, a bridging contact assembly can be utilized having a plurality of parallel bridging contacts and a plurality of biasing springs. The elongated contact arm is biased towards an open position when the bridging contact is separate from the stationary contacts, but with the circuit interrupter in the normally closed position is held in a closed position wherein the bridging contact is in engagement with the stationary contact. A latching mechanism which is responsive to a bimetal or magnetic trip to allow the circuit breaker to trip open during overload conditions, holds the elongated contact arm in the closed position.

15 Claims, 8 Drawing Figures

CIRCUIT INTERRUPTER HAVING AN INSULATED BRIDGING CONTACT

CROSS-REFERENCE TO RELATED APPLICATIONS

This application is related to U.S. patent Application Ser. No. 496,800 entitled "An Improved Distribution Transformer Secondary Circuit Breaker" filed Aug. 12, 1974, by J. F. Cotton et al. and assigned to the assignee of the present application.

BACKGROUND OF THE INVENTION

1. Field of the Invention

This invention relates to circuit interrupters and more particularly to a circuit interrupter for distribution transformers to control moderate power distribution on feeder circuits.

2. Description of the Prior Art

Transformers used in power distribution systems are generally associated with a protective device which prevents or limits current overload damage to the transformer and its associated apparatus. A completely self-protected transformer includes a circuit breaker on the secondary or low voltage side to protect against damage due to overload currents. The secondary circuit breaker disconnects the transformer from its load if the load current becomes dangerously high.

A problem exists in some of the prior art transformer circuit breakers which use plastic members for the operating and/or support of the circuit breaker. Holding the many dimensions with associated close tolerances requires extremely accurate molding. The hot oil environment in which the circuit breaker must function accurately is less than ideal for even the best plastic. The retention of the calibration during transformer processing and while in service depends to a large extent on the plastic materials maintaining their specific dimensions. For accuracy and cost of construction it is desirable that the number of movable plastic components in the circuit interrupter be minimized.

In prior art circuit breakers a flexible lead is required entering the circuit breaker at the stationary contact to provide for contact movement during contact closure. A flexible lead is also required between the moving contact and the bimetal, and another flexible lead is required to exit the breaker from the other end of the bimetal to allow for movement of the bimetal assembly during calibration and when the breaker is reset. The extensive use of copper braid, with the many brazes required, provides a circuit breaker which is difficult to calibrate and expensive to manufacture. It is desirable to have a circuit interrupter constructed to minimize the amount of flexible braid required.

Commonly used circuit interrupters incorporated bimetal thermal trip and instantaneous magnetic trip. For overload current it is desirable that circuit interruption be completed rapidly after initiation.

SUMMARY OF THE INVENTION

A circuit interrupter is provided which includes an elongated contact arm pivotable about one end with a bridging contact insulatively supported from the other end to form a series circuit between a pair of stationary contacts. The elongated contact arm is formed from a metallic material to provide for high strength, heat resistance, and inexpensive fabrication. An insulating member is rigidly attached to the free end of the elongated contact arm with the bridging contact supported from the insulating member. The bridging contact is spring biased away from the insulating member and a generally U-shaped retainer restricts movement of the bridging contact. Grooves or depressions formed in the insulating member are provided to restrict pivotal or rotational movement of the retainer and the associated bridging contact. A circuit interrupter can be provided having a plurality of poles wherein each elongated contact arm is connected by a rigid metallic member for simultaneous movement.

For larger power units of, for example, 75KVA, multiples of the single bridging concept are used to keep the temperature rise within acceptable limits. That is, a plurality of bridging contact members can be supported from a single elongated contact arm for providing a high capacity path through the circuit interrupter. The multiple contact paths provide for current flow which reduces contact temperature. They also induce both series and parallel arc paths to provide current limiting during circuit interruption.

Isolation of the contact system at the bridge by the insulation minimizes the electrically hot components and simplifies insulation. This permits the use of fewer plastic parts. The bridge and contact interface are constructed such that the bridge is square with the lower contact when they meet upon closing. Grooves are provided in the insulation to control the amount of bridge rotation during interruption.

The disclosed transformer secondary circuit breaker utilizes a single toggle and latching mechanism for operating two or three poles. The circuit breaker assembly is all metal with the exception of the conductor insulation. The only strand of copper conductor used is the flexible lead provided for attachment of the circuit breaker to the transformer terminals. Circuit interruption is provided by moving the bridging contact arm to open the pair of double break contacts. The disclosed invention reduces the number of required braided connections.

The secondary circuit breaker provides a pair of stationary contacts which can be connected by bridging contacts completing a series circuit therebetween. The bridging contact is disposed at the end of an elongated contact arm which pivots about an axis to move the bridging contact between a closed position completing an electric circuit through the pair of contacts and an open position spaced from the pair of contacts. A primary latch means is connected to the elongated contact arm for latching the contact in a closed position. A secondary latch means is provided for keeping the primary latch in the latched position. Bimetal actuating means, responsive to current, are provided for unlatching the secondary latch when current flowing through the circuit breaker exceeds a predetermined overload trip value. An overcenter toggle, which is spring biased towards a closed position, is connected to the elongated contact arm and is held in the overcenter extended position by the primary latch when the circuit breaker is in the normal closed position. When the secondary latch is unlatched, due to current overload of the circuit breaker, the primary latch moves to the unlatched position permitting the spring biased toggle to collapse opening the circuit interrupter with a snap action.

The disclosed transformer circuit breaker can also include a magnetic trip which instantaneously starts to trip the circuit breaker when current flow therethrough exceeds a high overload value. The magnetic trip can be a single piece of shaped steel which is disposed in close proximity to the bimetal to be drawn towards the bimetal when current flow through the bimetal exceeds the high overload value. The magnetic trip device can be formed integral with the latch to minimize time delay. As the magnetic trip element is drawn towards the bimetal the primary latch is unlatched permitting the circuit breaker trip open.

The contact arms of the various poles are rigidly connected to a metallic shaft, which has relatively high strength, for simultaneously movement. Each pole of the circuit interrupter can include bimetal thermal trip means and magnetic instantaneous trip means. A single emergency control can be provided for increasing, the amount of bimetal deflexion required through any pole to trip to circuit interrupter, thereby increasing the overload trip current level.

It is an object of the present invention to teach a circuit breaker having a bridging contact for completing an electrical circuit through two stationary contacts wherein insulation is provided at the bridging contact assembly for electrical isolation.

It is a further object of the present invention to teach a circuit interrupter utilizing a bridging contact wherein the bridging contact is positioned by a spring disposed between the contact and the operator for providing relatively pivotal movement for making good electrical connections to contacts in various states of wear.

BRIEF DESCRIPTION OF THE DRAWINGS

For a better understanding of this invention reference may be had to the preferred embodiments exemplary of the invention shown in the accompanying drawings in which.

DESCRIPTION OF THE PREFERRED EMBODIMENTS

Figure 1:
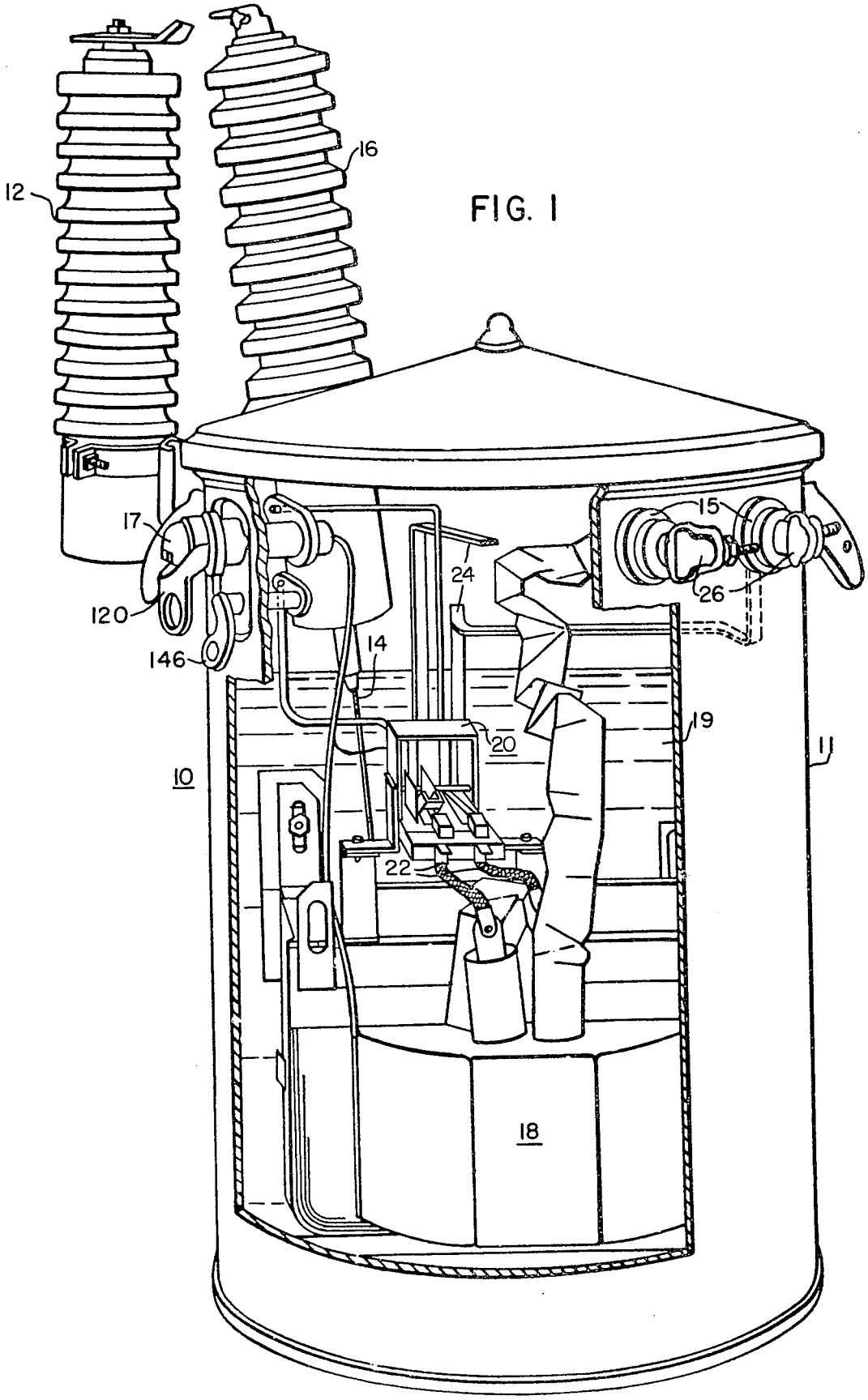
FIG. 1 is a perspective view of an oil filled distribution transformer utilizing the teaching of the present invention.

Referring now to the drawings and FIG. 1 in particular there is shown a pole-type completely self-protected transformer 10 including a circuit interrupter 20 utilizing the teaching of the present invention. The transformer 10 includes an enclosure or tank 11 with a lightning arrestor 12 and a primary high voltage bushing 16 mounted thereon. Secondary bushings such as the low voltage bushings 15 are attached to enclosure 11 to which the transformer load is connected. A signal light 17 is mounted on the enclosure 11 and is electrically connected to the circuit breaker 20 to be actuated at a predetermined low overload value. The core and coil assembly 18 is secured inside the enclosure 11 with the circuit breaker 20 attached thereto. Required primary winding leads 14 extend from the core and coil assembly 18 through the appropriate high voltage bushing 16. The housing 11 is partially filled with an insulating liquid dielectric 19, such as transformer oil. The circuit breaker 20 and the core and coil assembly 18 are immersed in the insulating oil 19. Secondary connections 22 coming from the core and coil assembly 18 connect to input terminals on circuit breaker 20. Conductors 24 connect the output terminals of circuit breaker 20 to the low voltage bushings 15 mounted to the transformer tank 11. Appropriate loads can then be connected to the low voltage terminals 26 of the distribution transformer 10.

Figure 2:
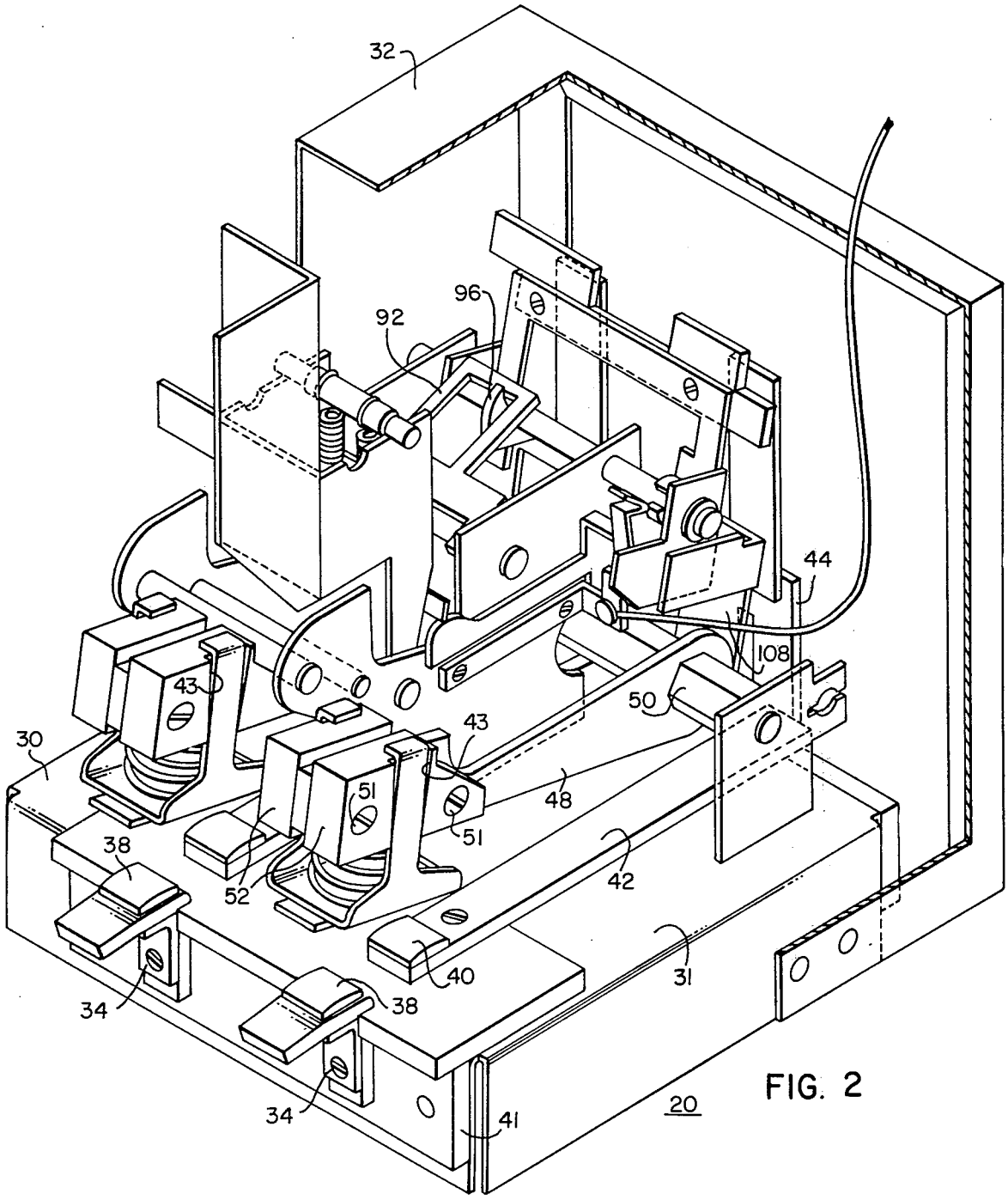
FIG. 2 is a perspective view of a secondary circuit interrupter for use on a distribution transformer utilizing the teaching of the present invention.

Referring now to FIGS. 2–5 there are shown embodiments of circuit breaker 20 utilizing the teaching of the present invention. FIG. 2 shows a perspective view of a two-pole circuit breaker 20 constructed in accordance with the present invention. The circuit breaker 20 is mounted on a metallic base 30 having a top flat planar surface 31. A cover 32 is provided partially surrounding the sensing and tripping elements of the circuit interrupter 20 to provide protection during handling. Secondary leads 22 of the core and coil assembly 18 are attached to incoming circuit breaker terminals 34 by suitable means such as brazing. Electrical conductors 24, disposed between the circuit breaker 20 and the low voltage transformer bushing 15, attach to circuit breaker 20 at terminals 36. Circuit breaker terminals 34 connect to stationary contact 38. Stationary contact 38 is disposed on a cantilevered portion 39 of terminals 34. Stationary contact support 34 is attached to insulating member 41 which is supported on the side of base 30. Thus stationary contact 38 is supported away from base 30 and is generally surrounded by insulating oil 19. Circuit breaker terminal 36 connects to a second stationary contact 40 through electrical conductor 42 and bimetal 44. Stationary contacts 38 and 40 of each pole are disposed in a spaced apart relationship with cantilever supported contacts 38 being spaced apart from base 30, surrounded by the insulating fluid 19.

A bridging contact 46 is provided which, with the circuit breaker in the closed position, completes an electrical connection between stationary contacts 38 and 40. Thus with the circuit interrupter 20 closed an electric circuit is completed from a terminal 34 through stationary contact 38, through bridging contact 46, through stationary contact 40, through electrical conductor 42, through bimetal 44, to circuit breaker terminal 36. The bridging contact assembly 45 includes a movable bridging contact 46 attached to one portion thereof which, when the circuit interrupter is closed, completes the electrical circuit between stationary contacts 38 and 40. By locating stationary contact 38 cantilevered away from base 30 faster circuit interruption is attained after contact opening is initiated. That is, it is believed that the free flow of oil around stationary contact 38 provides for faster circuit interruption.

In the disclosed distribution transformer the bridging contact is located below the bimetal 44. This is a most desirable feature since if for any reason a transformer should develop an oil leak the bimetal will be first to be exposed above the oil in the gas space and will heat up rapidly causing the breaker to trip while the contacts 46, 38 and 40 are still under the oil. This sequence of operation is desirable since it prevents contact arcing in the volatile gas space above the reduced oil level.

Each pole of the circit breaker 20 is provided with an elongated contact arm 48 which at one end is rigidly secured to a through shaft 50. Shaft 50, which can be a metallic member, connects together the elongated contact arms 48 of all poles of the circuit interrupter 20 for simultaneous movement. That is, the contact arms 48 are connected together through shaft 50 so they move in unison. The bridging assembly 45 is connected to the free end of the elongated contact arm 48 opposite shaft 50. Insulating members 52 are provided at the end of contact arm 48 so that contact arm 48 is electrically insulated from the bridging contact 46. A spring 55 is provided in contact assembly 45 to provide uniform contact pressure and proper seating of the bridging contact 46 on the stationary contacts 38 and 40. As can be seen from the drawings when any one of the poles of the circuit interrupter 20 open all the other poles must also open.

Figure 4:
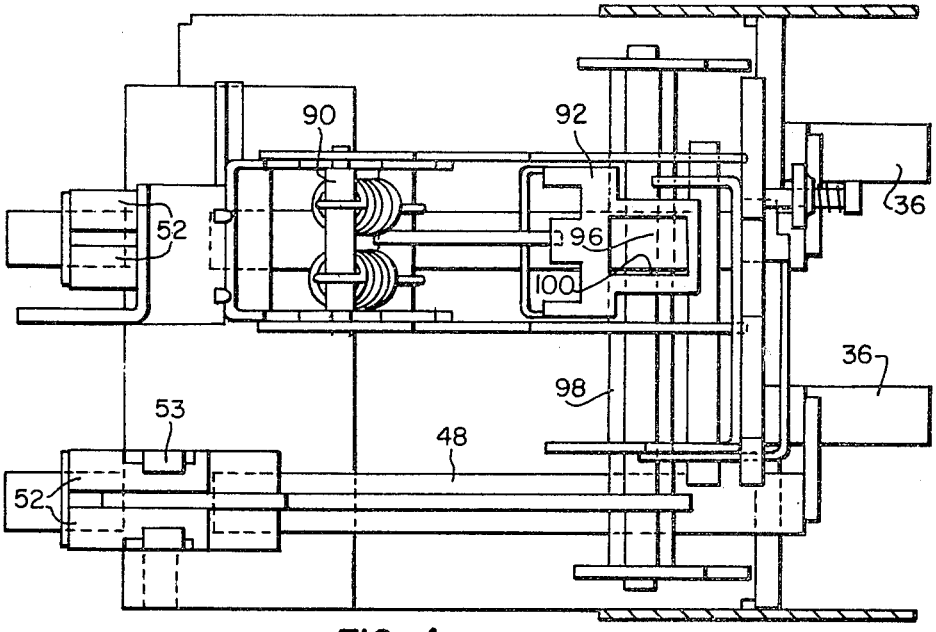
FIG. 4 is a top view of the circuit interrupter shown in FIG. 2.
Figure 3:
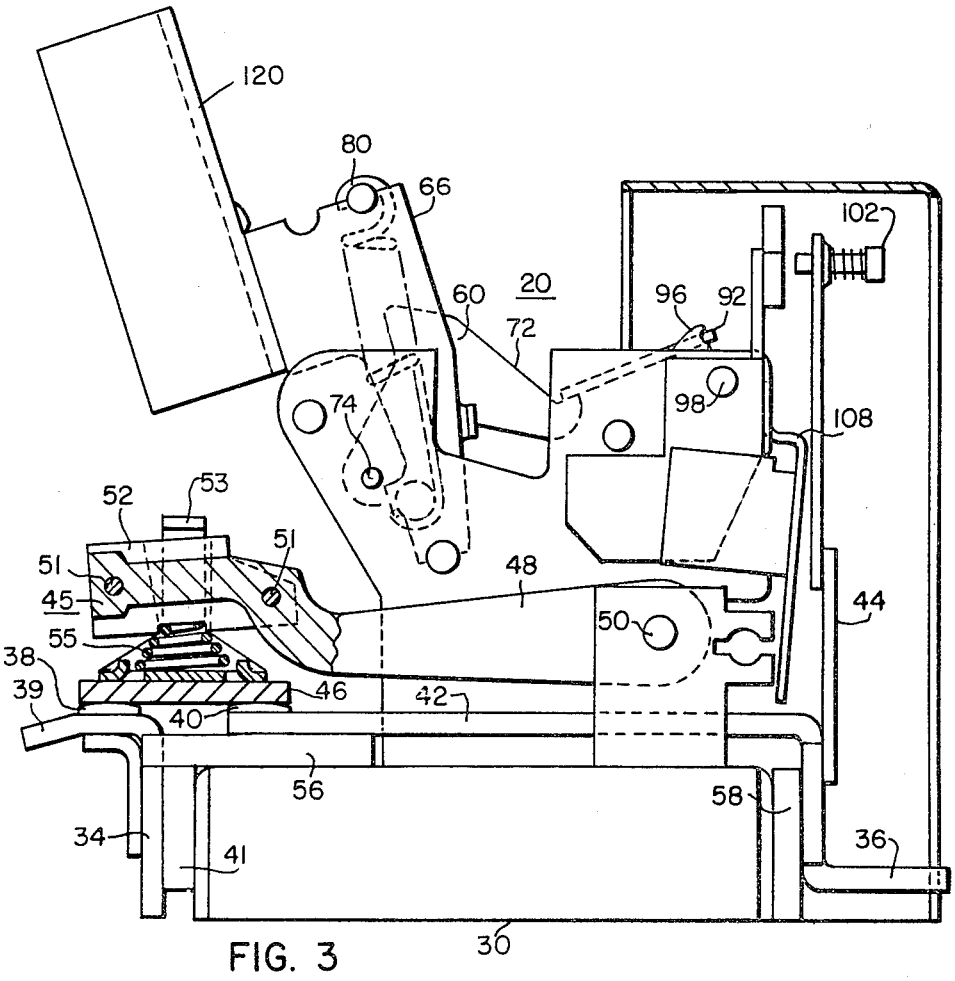
FIG. 3 is a side view of the circuit interrupter shown in FIG. 2.
Figure 5:
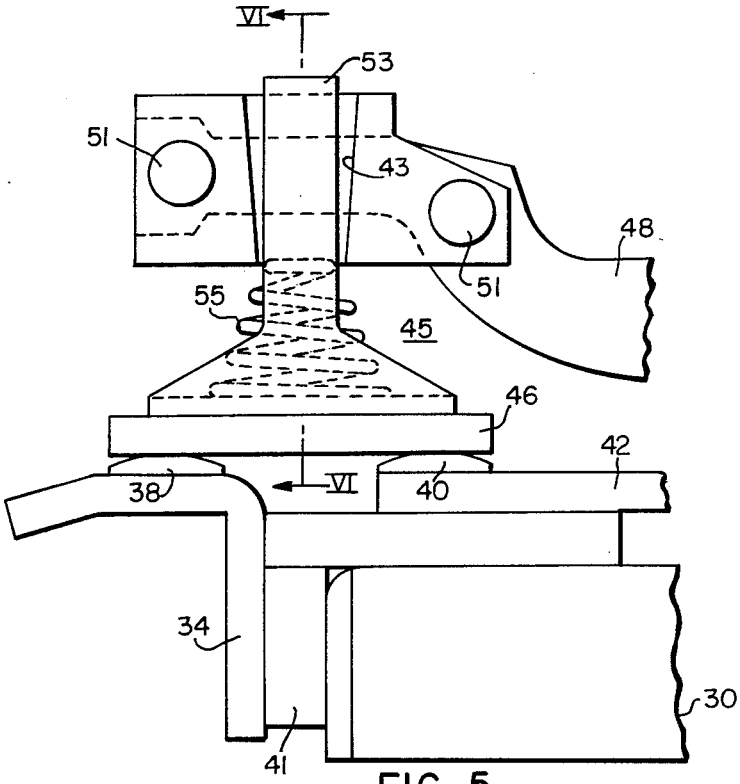
FIG. 5 is an enlarged side view of a portion of the circuit interrupter shown in FIG. 3.
Figure 6:
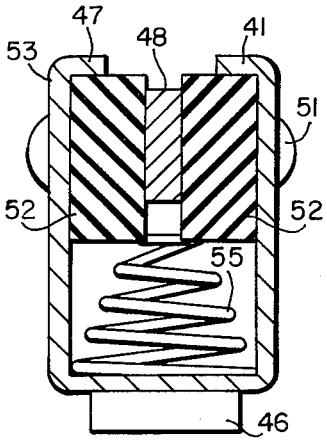
FIG. 6 is a view of the contact assembly shown in FIG. 5 along the lines VI—VI.

Referring now to FIGS. 3 and 4, there is shown a bridging contact assembly 45 constructed in accordance with the teaching of the present invention. Two insulating members 52 are secured on opposite sides of elongated contact arm 48 by fasteners 51. Thus the insulating members 52 are rigidly secured to elongated arm 48. A support member or retainer 53 having a generally U-shaped cross-sectional area, is provided with bridging contact 46 supported from the bight portion thereof. Tabs 47 (FIG. 6) are formed at the free ends of the U-shaped retainer 53 for positioning and limiting the movement of retainer 53. Spring 55 is disposed between the inner bight portion of U-shaped member 53 and the insulating blocks 52. Spring 55 with the circuit interrupter 20 in a closed position transmits a uniform closing force to bridging contact 46. This provides for good seating of the bridging contact 46 even when the stationary contacts 38 and 40 are worn or slightly misaligned. With the circuit interrupter 20 in the open position, biasing spring 55 forces tabs 47 into engagement with insulating members 52. The spring 55 also permits some pivotal movement of bridging contact 46 when the circuit interrupter 20 opens. During circuit interruption, initial arcing is initiated between stationary contacts 38, 40 and movable contact 46. Insulating members 52 have formed receiving grooves or depressions 43 therein which restrain the relative pivotal movement of retainer 53. These grooves 43 determine the maximum amount of pivotal or rotational movement of bridging contact assembly 45. Electrically isolating the bridging contact assembly at the free end of the elongated contact arm 48 minimizes the components subjected to an operating potential and simplifies the insulation requirements. This construction also permits the use of high strength steel components which can be subjected to higher torques permitting faster operation. The bridge assembly 45 is constructed so that the bridging contact 46 is square with the stationary contacts 38 and 40 when they are closed. The grooves 43 control the amount of bridge rotation during interruption.

Figure 7:
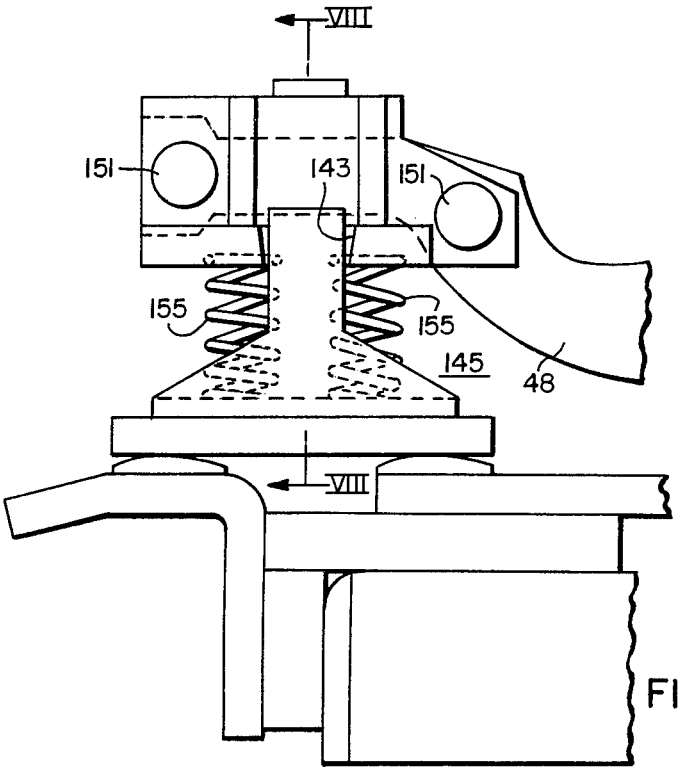
FIG. 7 is a view similar to FIG. 5 of another embodiment of the invention for larger power units; and, FIG. 8 is a view of the contact assembly shown in FIG. 7 along the lines VII—VII.
Figure 8:
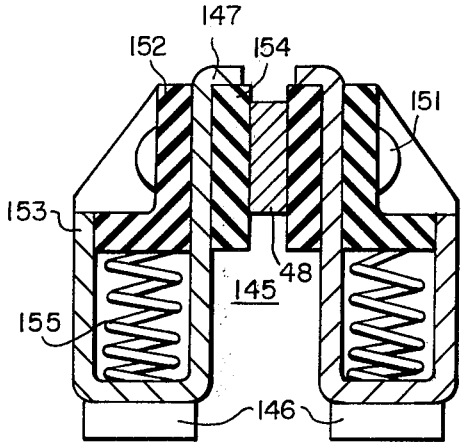

Referring now to FIGS. 7 and 8 there is shown a bridging contact assembly 145 which is particularly suitable at higher ratings above 75KVA. In this construction two bridging contacts 146 are required for each pole. Two springs 155 are associated with each side of the bridging contact assembly 145. Each side of the bridging contact assembly 145 can pivot independently of the other side. Two insulating pieces 152 and 154 are provided for retaining each retainer 153. Each retainer 153 includes a tab 147 which is forced into engagement with insulating member 154 by the biasing springs 155. A slot 143 is formed in each insulating member 152 to limit relative movement of each retainer 153. Fasteners 151 connect contact assembly 145 to elongated contact arm 48. The contact arm can be formed of a metal such as steel having relatively high strength. A plurality of bridging contacts 146 for each pole provides additional current paths which reduce contact temperature. These multiple bridging contacts also provide arc paths in series and parallel to enhance current limiting during interruption.

Through shaft 50 is rotatably supported by brackets which are attached to the metallic base 30. Stationary contact 40 is electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit interrupter 20 during normal operation. Conductor 42 which is generally L-shaped has its short leg portion attached to one leg of bimetal 44. The other leg of bimetal 44 attaches to L-shaped terminal 36. A single operating mechanism 60 is provided for operating all poles of the circuit interrupter 20. Operator 60 is connected to one of the elongated contact arms 48 and as this contact arm 48 is moved, in response to the positioning of the operator 60, the other elongated contact arm 48, connected through shaft 50, also responds. The single operating mechanism 60 for all poles is mounted on side plates which are securely attached to support base 30. The operating mechanism, which is described more fully in copending application Ser. No. 496,800, comprises a U-shaped operating member 66, the two legs of which are pivotally connected to the side plates. A primary latch 72 is provided and is pivotally connected to a shaft disposed between the side plates. A pair of toggle links are provided with one end of the toggle connected to the elongated contact arm 48 and the other end of the toggle connected to primary latch 72 and having multiple springs 80 connected between the knee of the toggle and the top of U-shaped member 66 for raising contact arm 48 with a snap action when primary latch 72 is released. The toggle links are pivotally connected together by a knee pivot pin. The lower toggle member is connected at its lower end to elongated contact arm 48. The upper ends of the pair of toggle links have a U-shaped slot formed therein which fits around a shaft connected to primary latch 72. A shaft 90 sits on top of U-shaped member 66 and is engaged by the upper end of springs 80. The upward force exerted by springs 80 holds the toggle links in engagement with primary latch 72. Primary latch 72 is releasably held in a latched position by secondary latch 92. Secondary latch 92 is biased toward an unlatched position by a torsion spring. When secondary latch 92 moves to the unlathced position primary latch 72 is released and rotates around shaft 74 due to the force of springs 80 collapsing the toggle and raising the elongated contact arm 48.

Secondary latch 92 is prevented from moving to the unlatched position when the breaker is closed by a cam surface 96 which is part of a trip bar mechanism 98. With the circuit breaker normally closed, a portion of secondary latch 92 rests against the cam surface 96. When the trip bar mechanism is rotated a predetermined angle counterclockwise, as viewed in FIG. 3, the cam surface 96 passes through opening 100 in secondary latch 92 permitting secondary latch 92 to rotate to the unlatched position, releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 is provided with an individual trip device including a current responsive bimetal element 44, through which the load current of the associated pole passes. That is, the bimetal element 44 is electrically connected in the circuit of the circuit breaker 20 in series relation with the breaker contacts 38, 40 and 46. The bimetal 44 is generally U-shaped with an adjusting screw 102 threadedly mounted in the bight portion. One leg of the bimetal 44 is connected to fixed conductor 42 and the other leg of bimetal 44 is connected to fixed terminal 36. The adjusting screw is disposed so as to contact an insulating portion of trip bar mechanism 98 when bimetal 44 deflects. Upon occurrence of, for example, an overload of less than 500% of normal rated current, the bimetal element is heated and deflects toward the trip bar mechanism 98. As the bimetal element deflects due to the flow of current therethrough, the rounded edge of adjusted screw engages the insulating sheet attached to trip bar mechanism 98, rotating the trip bar 98 counterclockwise to a tripped position releasing secondary latch 92 and tripping open the circuit interrupter 20. The cam portion 96 of trip bar mechanism 98 moves from under the latching surface to release the secondary latch 92. Primary latch 72 then rotates around pivot 74 moving the line of action of the springs 80 to the left of toggle pivot knee causing the toggle to collapse, opening the circuit interrupter 20 with a snap action.

Electromagnetic means is also provided to instantaneously trip the breaker. The electromagnetic trip means comprises a ferromagnetic member 108, disposed in proximity to bimetal element 44. Ferromagnetic member 108 is rigidly secured to trip bar 98 for unitary movement therewith. Upon occurrence of a high overload current of, for example, greater than 500% of normal rated current flowing through the bimetal 44, the electromagnetic trip member 108 is drawn towards bimetal 44 in response to the overload current whereupon trip bar mechanism 98 rotates to trip open the circuit interrupter 20. Electromagnetic trip member 108 almost instantaneously trips open the circuit breaker 20 in the high overload conditions without moving bimetal 44. As can be seen in FIG. 3 as electromagnetic element 108 is drawn towards bimetal 44 trip bar 98 rotates to release secondary latch 92 causing the circuit breaker 20 to trip open. The breaker 20 opens and current flow through the bimetal ceases and electromagnetic member 108 returns to its tripped position. Trip member 108 has a plurality of legs each of which are slightly spaced apart from an associated bimetal 44.

Operating handle 120 is movable between an on position closing the circuit breaker 20 and an off position opening circuit breaker 20. The circuit breaker contacts 38, 40 and 46 are manually opened by clockwise movement of operating member 66, as operating handle 120 is moved to the off position. Clockwise movement of the operator 66 carries the line of action of the overcenter springs 80 to the right whereupon the force of springs 80 cause a collapse of the toggle thereby moving the bridging contact 46 to the open position with a snap action. The contacts are closed by counterclockwise movement of the operator 66, as seen in FIG. 3. This moves the line of action of the springs 80 across to the left, consequently the springs 80 actuate the toggle to its extended overcenter position thereby moving the movable bridging contact 46 to the closed position with a snap action.

When the circuit interrupter 20 has tripped open, the primary latch 72 and the secondary latch 92 must be reset to a latched position before the circuit breaker can be closed. Relatching of the operating mechanism is effectuated by movement of the operator handle beyond the off position. Moving the operator handle to the off position moves operating part 66 in a clockwise direction. As operating part 66 is moved beyond the normal off position latch 72 engages a portion of secondary latch 92 rotating secondary latch 92 in a counterclockwise direction releasing trip bar 98 and permitting trip bar 98 to rotate under the influence of a biasing spring. Trip bar rotates to a position securing latch 92. Trip bar 98 thus rotates to a position where cam surface 96 acts as a support for secondary latch 92, holding secondary latch 92 latched. The circuit breaker 20 may then be closed by movement of the operating handle 120 to the on position causing the circuit breaker 20 to close in the previously described manner.

We claim as our invention:

1. A circuit interrupter comprising:

a first stationary contact;

a second stationary contact separated from said first stationary contact;

bridging contact means;

an elongated contact arm, having said bridging contact means connected thereto, pivotal about an axis between a closed position wherein said bridging contact means completes an electric circuit between said first stationary contact and said second stationary contact and an open position wherein said bridging contact means is spaced apart from said first stationary contact and said second stationary contact;

insulating means connected to the free end of said elongated contact arm disposed between said elongated contact arm and said bridging contact means to support said bridging contact means in an insulating relationship from said elongated contact arm;

primary latch means connected to said elongated contact arm having a latching position latching said elongated contact arm in the closed position;

a secondary latch having a latched position keeping said primary latch means in the latching position; and, bimetal actuating means responsive to current flow for unlatching said secondary latch when current flow through the circuit interrupter exceeds a trip level for a predetermined period of time whereby said primary latch is released and said elongated contact arm can move to the open position.

2. A circuit interrupter as claimed in claim 1 wherein said insulating means comprises:

an insulating member rigidly connected to said elongated contact arm;

a support member of generally U-shaped cross-section having two legs and an inner bight portion, said support member being disposed with said insulating member between said its legs and said bridging contact connected to said bight portion; and, tabs formed on the free ends of the U-shaped support member to maintain the U-shaped support member around said insulating member.

3. A circuit interrupter as claimed in claim 2 comprising:

a spring disposed between the inner bight portion of said U-shaped support member and said insulating member; and, grooves formed in said insulating member to restrict rotational movement of said U-shaped support member.

4. A secondary circuit breaker disposed in the oil filled housing of a distribution transformer comprising:

a plurality of poles each being connected in series with the secondary of the distribution transformer;

each pole comprising a pair of stationary contacts, a bridging contact, an elongated metallic contact arm, an insulating member insulatably supporting said bridging contact from said elongated contact arm, each elongated contact arm movable between an open position when said bridging contact is spaced from said pair of stationary contacts and a closed position wherein said bridging contact engages said pair of stationary contacts;

a connecting rod formed of a metallic material rigidly supported for rotational movement about an axis and having said elongated contact arms connected thereto; and, operating means linked to said connecting rod for opening all poles of the circuit interrupter when current flow through any pole of the circuit interrupter exceeds a selected current level.

5. A circuit breaker as claimed in claim 4 wherein each pole comprises:

a U-shaped support member having two legs and a bight portion, and disposed between said bridging contact and said insulating member, said bridging contact being attached to the bight portion, and the legs of said U-shaped member being disposed around said insulating member.

6. A circuit breaker as claimed in claim 5 wherein each pole comprises:

a spring disposed between the inner bight portion of said U-shaped support member and said insulating member to bias said bridging contact away from said insulating member; and, projections extending from the free ends of said U-shaped support member legs for maintaining said U-shaped support member in engagement with said insulating member.

7. A circuit breaker as claimed in claim 6 wherein said insulating member of each pole has a groove formed therein within which the legs of said U-shaped support member are disposed to restrict rotational movement of said U-shaped support member.

8. A circuit interrupter comprising:

a stationary contact;

a movable contact;

an elongated contact arm pivotal about a fixed axis;

insulating means connected to the movable end of said elongated contact arm and insulatably supporting said movable contact from the free end of said elongated contact arm;

spring biasing means biasing said elongated contact arm to an open position wherein said movable contact is separated from said stationary contact;

latching means for latching said elongated contact arm in a closed position wherein said movable contact is in engagement with said stationary contact; and, tripping means for releasing said latching means under predetermined overload current conditions.

9. A circuit interrupter as claimed in claim 8 wherein said insulating means comprises:

at least one insulator rigidly connected to said elongated contact arm, biasing means disposed between said movable contact and said insulator for biasing said movable contact away from said insulator; and, retaining means for restricting the movement of said movable contact with respect to said insulator.

10. A circuit interrupter as claimed in claim 8 wherein said insulating means comprises a pair of insulating members disposed around and rigidly connected to said elongated contact arm; and including, retaining means formed of a generally U-shaped cross-sectional member having two legs and a bight portion, said U-shaped member disposed around said pair of insulating members and having the movable contact connected to the bight portion thereof; and, a biasing spring disposed between the inner bight portion of the U-shaped retaining member and said insulating members.

11. A circuit interrupter as claimed in claim 9 comprising a plurality of poles wherein each pole is constructed as claimed in claim 9, said interrupter comprising a connecting rod formed of a metallic material and rigidly connecting the elongated contact arms of each pole.

12. A circuit interrupter as claimed in claim 9 wherein said insulating members have depressed portions formed therein within which a portion of the legs of the U-shaped support member are disposed to restrict rotational movement of said U-shaped support members.

13. A circuit interrupter, comprising:

a pair of stationary contacts;

a movable bridging contact;

an elongated metallic contact arm pivotal at one end about a fixed axis between open and closed positions;

insulating means rigidly attached to the free end of said elongated metallic contact arm and comprising a receiving portion, said insulating means resiliently supporting said movable bridging contact in a manner electrically insulated from said elongated metallic contact arm so that said movable bridging contact electrically connects said stationary contacts when said elongated metallic contact arm is in a closed position and said movable bridging contact is spaced away from said stationary contacts when said elongated metallic contact arm is in an open position.

14. A circuit interrupter as claimed in claim 13 comprising a support member, said support member comprising a support surface and positioning means, said movable bridging contact being attached to said support surface, and said positioning means extending into said receiving portion of said insulating means.

15. A circuit interrupter as claimed in claim 14 wherein said receiving means comprises at least one pair of convergent surfaces receiving said positioning means.

* * * * *